US008890640B2

(12) United States Patent
Körber

(10) Patent No.: US 8,890,640 B2
(45) Date of Patent: Nov. 18, 2014

(54) DRIVE FOR A SWITCH DISCONNECTOR WITH C O SWITCHING CAPACITY

(71) Applicant: ABB Technology AG, Zürich (CH)

(72) Inventor: Franz-Josef Körber, Altenstadt (DE)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/755,184

(22) Filed: Jan. 31, 2013

(65) Prior Publication Data

US 2013/0135066 A1 May 30, 2013

Related U.S. Application Data

(63) Continuation of application No. PCT/EP2011/003356, filed on Jul. 6, 2011.

(30) Foreign Application Priority Data

Aug. 2, 2010 (DE) ..... 10 2010 033 042

(51) Int. Cl.

| | |
|---|---|
| ***H01H 3/00*** | (2006.01) |
| ***H01H 3/26*** | (2006.01) |
| ***H01H 5/06*** | (2006.01) |
| ***H01H 3/30*** | (2006.01) |
| *H01H 31/00* | (2006.01) |

(52) U.S. Cl.

CPC ..... *H01H 3/26* (2013.01); *H01H 31/00* (2013.01); *H01H 5/06* (2013.01); *H01H 3/3052* (2013.01)

USPC ..... 335/189; 335/172

(58) Field of Classification Search

USPC ..... 335/189

See application file for complete search history.

(56) References Cited

U.S. PATENT DOCUMENTS 2,776,346 A * 1/1957 Stewart et al. ..... 200/50.24
2,849,569 A * 8/1958 Scott, Jr. ..... 335/40

(Continued)

FOREIGN PATENT DOCUMENTS

CH 424932 11/1966
DE 1098071 1/1961

(Continued)

OTHER PUBLICATIONS

International Search Report (PCT/ISA/210) issued on Nov. 22, 2011, by the European Patent Office as the International Searching Authority for International Application No. PCT/EP2011/003356.

(Continued)

*Primary Examiner* — Shawki S Ismail
*Assistant Examiner* — Lisa Homza
(74) *Attorney, Agent, or Firm* — Buchanan Ingersoll & Rooney PC

(57) ABSTRACT

Exemplary embodiments relate to a drive for a switch disconnector having C or O switching capacity and a switching pin acting as switching contact. A spindle drive is driven by an electric motor and has a spindle nut. An actuating element, which is loaded by a compression spring and is capable of pivoting about a fixed pivot point, is acted upon by the spindle nut. The actuating element for its part interacts with an actuating apparatus which actuates the switching pin.

15 Claims, 3 Drawing Sheets

(56) References Cited

U.S. PATENT DOCUMENTS

| | | | | | |
|---|---|---|---|---|---|
| 2,921,998 | A | * | 1/1960 | Pokorny et al. | 200/50.26 |
| 3,019,309 | A | * | 1/1962 | Goodwin, Jr. | 200/50.23 |
| 3,577,887 | A | * | 5/1971 | Lambert et al. | 74/2 |
| 3,772,489 | A | * | 11/1973 | Wilson | 200/50.23 |
| 3,778,568 | A | * | 12/1973 | Wilson | 200/50.22 |
| 3,784,764 | A | * | 1/1974 | Wilson | 200/50.24 |
| 3,793,493 | A | * | 2/1974 | Wilson | 200/50.24 |
| 3,823,281 | A | * | 7/1974 | Wilson | 200/50.24 |
| 4,760,224 | A | * | 7/1988 | Genba | 200/400 |
| 6,180,902 | B1 | * | 1/2001 | Kowalyshen et al. | 200/400 |
| 2006/0006143 | A1 | | 1/2006 | Corti | |

FOREIGN PATENT DOCUMENTS

| | | | |
|---|---|---|---|
| DE | 68025 | | 11/1968 |
| DE | 1665806 | | 3/1971 |
| DE | 3131219 | A1 | 12/1982 |
| DE | 4227953 | C1 | 3/1994 |
| DE | 19534392 | A1 | 3/1997 |
| EP | 1993115 | A1 | 11/2008 |

OTHER PUBLICATIONS

German Search Report issued Nov. 8, 2010 for German Application No. 102010033042.6.

* cited by examiner

DRIVE FOR A SWITCH DISCONNECTOR WITH C O SWITCHING CAPACITY

RELATED APPLICATION(S)

This application claims priority as a continuation application under 35 U.S.C. §120 to PCT/EP2011/003356, which was filed as an International Application on Jul. 6, 2011 designating the U.S., and which claims priority to German Application 10 2010 033 042.6 filed in Germany on Aug. 2, 2010. The content of these applications are hereby incorporated by reference in their entireties.

FIELD

The disclosure relates to a drive for a switch disconnector with C and O switching capacity with a switching pin acting as a switching contact and with a spindle drive driven by an electric motor having a spindle nut.

BACKGROUND INFORMATION

A switch disconnector is an electrical high-voltage switch with low current switching capacity for high-voltage systems. It usually has switching error protection which prevents inadvertent opening and closing under load. In the event of a switching operation under load, a known switch disconnector would be damaged due to the arc which would occur.

C and O switching capacity means that the switch so designated, in the present case a switch disconnector, provides a switching capacity to be specified within a C or O circuit. This switching capacity is determined by the switching speed.

Now back to the actual switch disconnector, which, as already explained, is used as an electrical high-voltage switch with limited current switching capacity for high-voltage systems or high-voltage switchgear systems. Circuit breakers or load isolating switches with high current switching capacity, which, as a rule, are combined in series with the switch disconnector, can be specified to isolate the electrical connection under load.

Accordingly, although, as intended, switch disconnectors are actuated exclusively when circuit breakers are open, as a result of the control capacitances over the circuit breaker switching paths, that is to say the capacitance of the connected parts of the network, the compensating currents associated with these capacitances have to be switched on and off.

Switch disconnectors are therefore designed for a minimum switching capacity, so that, when switching capacitive busbar currents, inductive currents of transformers on no load and also during bus current transfer switching, the arc contacts of the pin contacts of the switch disconnector do not wear or at least do not wear too quickly, for example, as transient overvoltages which promote the formation of arcs are produced as a result of rupturing the arc at alternating frequencies.

The switching time of a known motor drive for the switch disconnector is approximately 1 second, for example, and the switching speed is approximately 0.1 m/s. As a result of the duration of the arc when capacitive busbar currents are switched, inductive currents of transformers on no load and also during bus current transfer switching, the arc contacts of the disconnector pins are subject to wear. For these reasons, the switching of transformers operating on no load has previously only been possible using a high-speed circuit breaker (transformer panel).

On the other hand, as a consequence of its very short arcing times, a high-speed switch disconnector can avoid this disadvantage and, when correctly rated, is suitable for switching transformers on no load. It therefore replaces a circuit breaker.

Starting from this prior art, exemplary embodiments of the present disclosure specify a switch disconnector that is optimized with regard to its switching behavior for a fast switching capacity and can be produced in a simple manner and with little effort.

SUMMARY

An exemplary drive for a switch disconnector is disclosed comprising: a C and O switching capacity with a switching pin acting as a switching contact; a spindle drive driven by an electric motor having a spindle nut; and an actuating element which is loaded by a compression spring and is capable of pivoting about a fixed pivot point and is acted upon by the spindle nut, wherein the actuating element interacts with an actuating device that actuates the switching pin.

DETAILED DESCRIPTION

Figure 1:
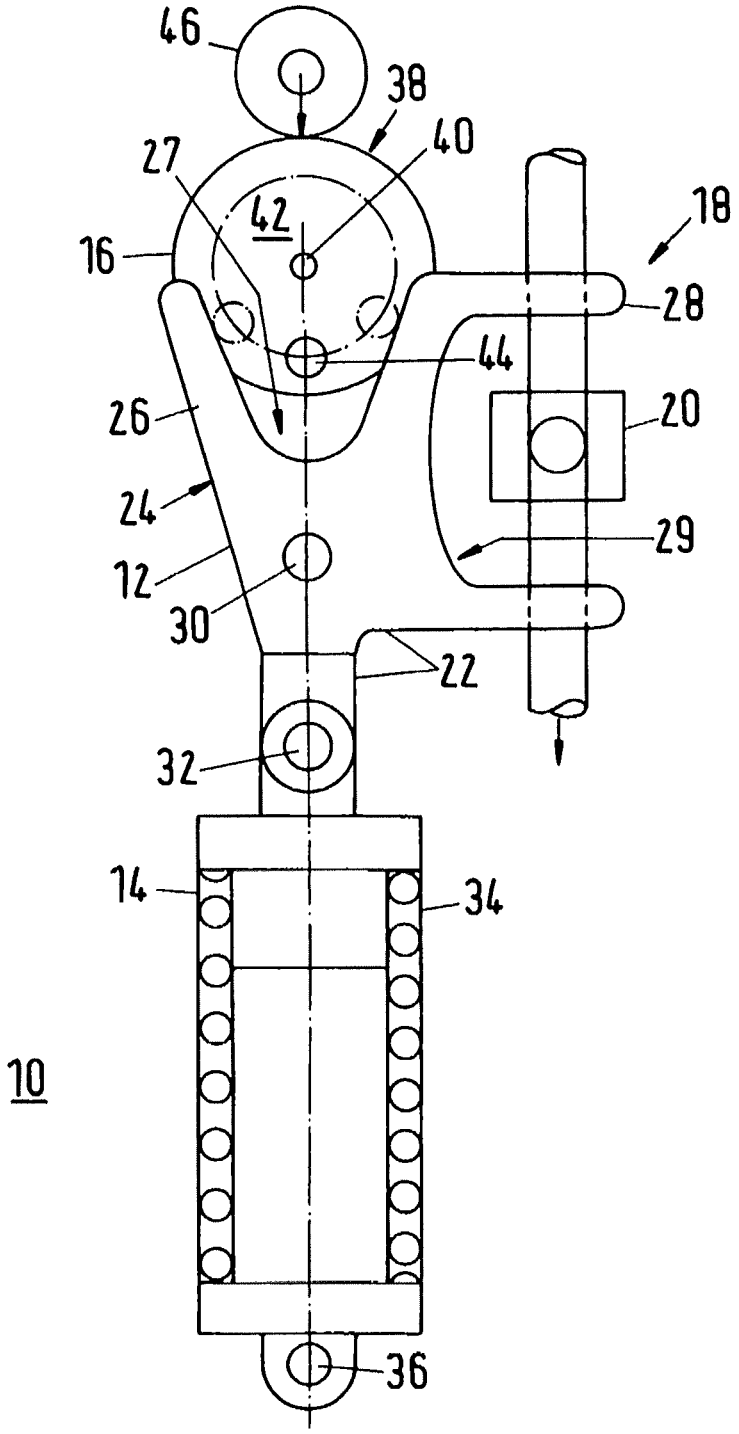
FIG. 1 shows a schematic diagram of a drive in a metastable central position in accordance with an exemplary embodiment of the present disclosure.

Exemplary embodiments of the present disclosure provide an actuating element which is loaded by a compression spring and is capable of pivoting about a fixed pivot point and is acted upon by a spindle nut, wherein the actuating element for its part interacts with an actuating device which actuates the switching pin.

Advantageously, with the drive according to the disclosure, it is provided that the actuating element is flexibly connected to the compression spring, wherein, according to an exemplary embodiment of the disclosure, the compression spring is formed by a spring assembly which is bistably mounted.

In another exemplary embodiment of the drive according to the disclosure, the compression spring is immovably mounted on the side opposite the connecting point of the actuating element.

This creates an arrangement which, with the help of an inherent spring force of the compression spring, effects a pivoting movement of the actuating element about its fixed pivot point by assuming the opposite of the two stable positions as soon as the actuating element is acted upon by the spindle nut and is moved from its current position.

According to an exemplary embodiment of the disclosure, the actuating device is formed by an actuating disk or an actuating cylinder, the peripheral surface of which engages with an actuating shaft, by means of positive engagement, in order to actuate the switching pin.

In another exemplary embodiment of the drive according to the disclosure, a face surface of the actuating disk or the actuating cylinder is provided with at least one eccentrically arranged actuating bolt which can be acted upon by the actuating element for the purpose of rotationally actuating the actuating disk or the actuating cylinder.

For this purpose, the actuating element, which is can be in the form of a double switching fork e.g., provided with two switching forks, acts, such that the spindle nut engages in a first switching fork and actuates depending on the movement of the associated spindle drive, and a second switching fork acts on at least one of the actuating bolts which are eccentrically arranged on the one face surface of the actuating disk or the actuating cylinder and by this means sets the actuating disk or the actuating cylinder into rotation.

Advantageously, an exemplary drive according to the present disclosure has a compression spring with a spring force which guarantees the C or O switching capacity of the drive.

An exemplary embodiment according to the present disclosure relates to a fast-operating switch disconnector drive according to the coil spring principle. The contact pin is securely held in the end positions (ON and OFF) by the residual tension of the springs. The switching operation is introduced by the motor-driven spindle gearbox. While the isolator pin initially remains at rest, the spring is already tensioned in the direction of the unstable central position and the actuating element rests against the switching shaft.

When this touch contact has been established, the spring relaxes and moves out of the metastable central position into the appropriate stable end position in which the switch disconnector is open. The angle of rotation of the actuating device on which the switching fork acts is approximately 80° to 100°, for example. Translation to larger angles of rotation of 286° or 306° for example, can be realized by means of a gear unit.

The conditions for coupling the exemplary high-speed switch disconnector drive according to the present disclosure to existing switch disconnectors are therefore ideal, on account of the existing rotary transmission device of the switch disconnector.

The disclosure, advantageous embodiments, and improvements of the disclosure and advantages of the disclosure are explained and described in more detail with reference to an exemplary embodiment which is shown schematically in the attached drawing.

FIG. 1 shows a schematic diagram of a drive in a metastable central position in accordance with an exemplary embodiment of the present disclosure. As shown in FIG. 1, an exemplary embodiment of the drive 10 according to the disclosure which has an actuating element 12, a compression spring 14, an actuating device 16 and a spindle drive 18 with a spindle nut 20 located thereon.

For its part, the actuating element 12 has a double switching fork 24 which connects to a flange part 22 and has a first and a second switching fork 26, 28, wherein the actuating element 12 can be pivoted about a pivot point 30 which is arranged fixed in the flange part 22.

Further, the end of the flange part 22 which faces away from the double switching fork 24 is flexibly connected to the compression spring 14 in a combined joint 32. In the exemplary embodiment shown, the compression spring 14 is in the form of a spring assembly and is arranged in a cylindrical sleeve 34 which has the combined pivot joint 32 at its end which faces the actuating element 12, while the opposite end of the sleeve 34 is mounted so that it can pivot about a fixed pivot point 36.

The switching forks 26, 28, which are combined in the double switching fork 24 of the actuating element 12, are adjacent but not in the same direction, that is to say their fork openings do not point in the same direction but their alignment is offset by 90°, for example, with respect to one another.

While the fork opening 27 of the first switching fork 26 points in the direction of the extension of the line connecting the pivot joint 32 to the fixed pivot point 30 in the flange part 22 towards the actuating device 16, the fork opening 29 of the second switching fork 28 is arranged perpendicular or at some other angle hereto in the direction of the already mentioned spindle drive 18 with the spindle nut 20.

The actuating device 16 is formed by a circular cylinder 38 which is arranged so that it can pivot about a central axis 40 which cuts the extension of the line connecting the pivot joint 32 to the fixed pivot point 30 in the flange part 22 on the actuating device 16 at right angles, that emerges at right angles from the plane of the drawing.

Attached to its face surface 42 which is adjacent to the actuating element 12 and runs parallel to the plane of the drawing is a switching bolt 44, which serves to engage alternately with the first switching fork 26, which, depending on the action of the actuating element 12, in each case moves it out of the metastable central position shown in FIG. 1 with reference to the compression spring 14 into one of two stable end positions, firstly by means of the compression spring 14 and secondly by means of the spindle nut 20, as a result of which the actuating device 16, that is to say the circular cylinder, is rotated accordingly.

Engaged with the actuating device 16 is a switching shaft 46, which is arranged parallel with the axis thereof and, in a manner which is not shown in more detail, actuates the associated switching contact of the switch disconnector, which is likewise not shown in more detail.

Figure 2:
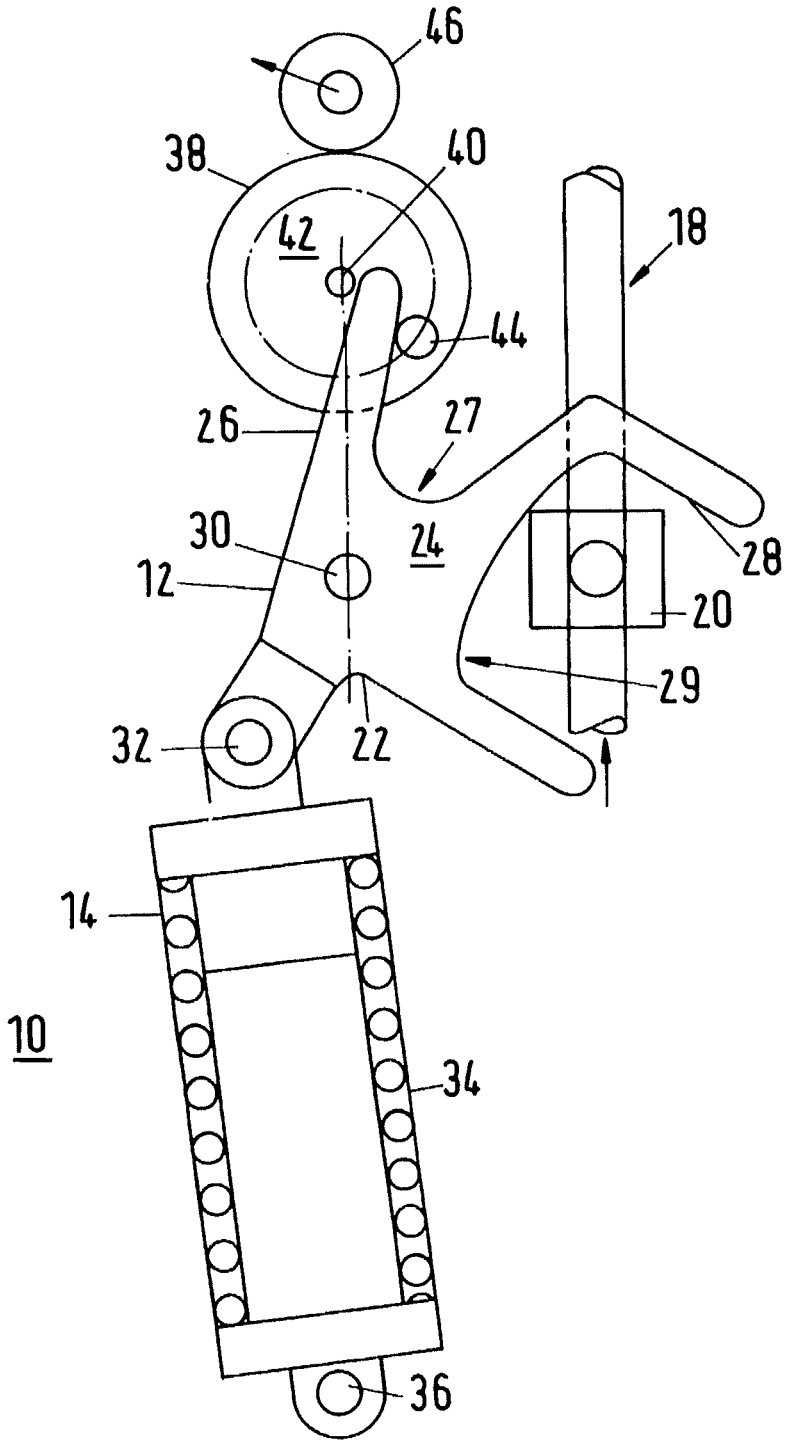
FIG. 2 shows a schematic diagram of the drive in a stable first end position in accordance with an exemplary embodiment of the present disclosure.

FIG. 2 shows a schematic diagram of the drive in a stable first end position in accordance with an exemplary embodiment of the present disclosure. As shown in FIG. 2, the compression spring 14 is in one of its two stable end positions which has been initiated by downwards movement of the spindle nut 20.

Furthermore, it can easily be seen that, in this position, the pivot joint 32 between the actuating element 12 and the compression spring 14 has moved sideways, e.g., to the left, away from the straight line formed by the line connecting the pivot point 30 in the actuating element 12 with the pivot point 36 of the compression spring 14, as a result of which the first switching fork 26 acts on the switching bolt 44 of the actuating device 16 to the right. As a result, the switching shaft 46 is again turned in the opposite direction of rotation.

Figure 3:
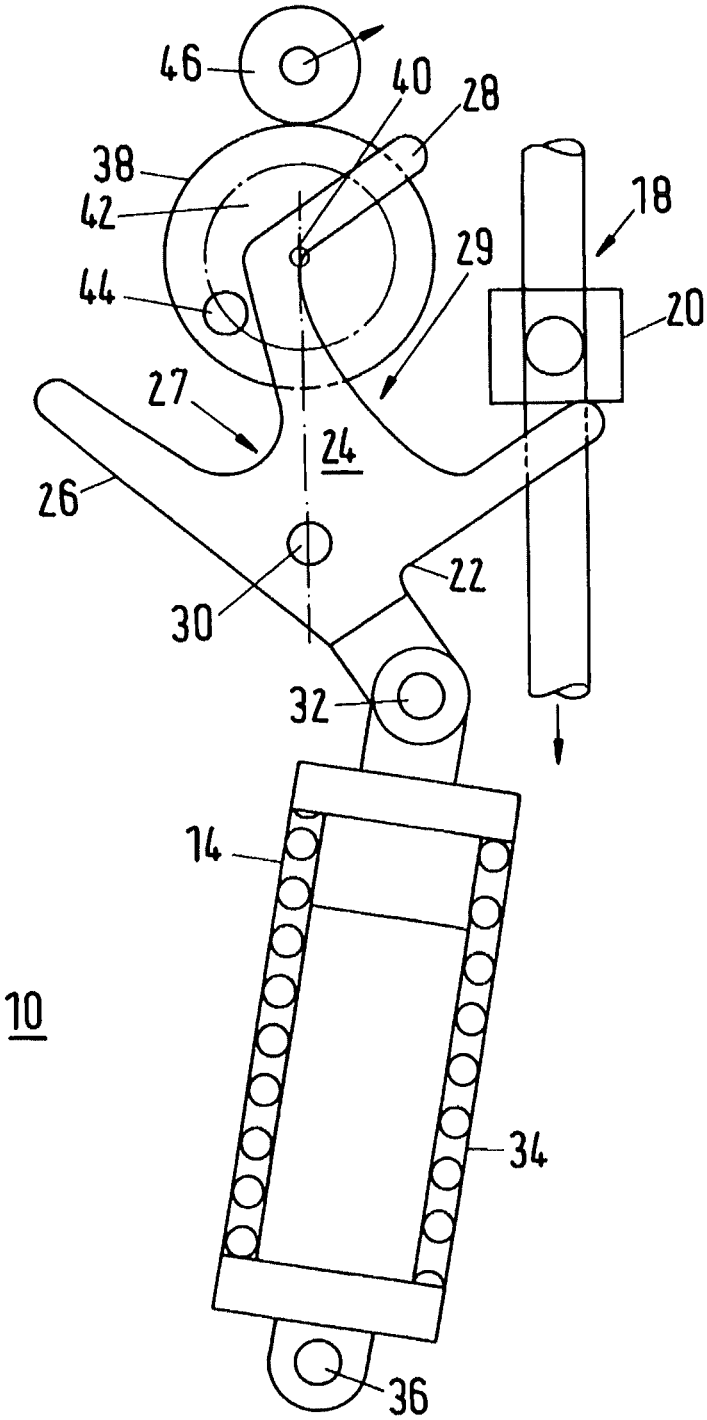
FIG. 3 shows a schematic diagram of the drive in the stable second end position in accordance with an exemplary embodiment of the present disclosure.

FIG. 3 shows a schematic diagram of the drive in the stable second end position in accordance with an exemplary embodiment of the present disclosure. As shown in FIG. 3, the compression spring 14 is in one of its two stable end positions which has been initiated by upwards movement of the spindle nut 20.

In this position, the pivot joint 32 between the actuating element 12 and the compression spring 14 has moved sideways, e.g., to the right, away from the straight line formed by the line connecting the pivot point 30 in the actuating element 12 with the pivot point 36 of the compression spring 14, as a result of which the first switching fork 26 acts on the switching bolt 44 of the actuating device 16 to the left. As a result of this, the switching shaft 46 is again turned in the opposite direction of rotation.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCES

10 Drive
12 Actuating element
14 Compression spring
16 Actuating device
18 Spindle drive
20 Spindle nut
22 Flange part
24 Double switching fork
26 First switching fork
27 First fork opening
28 Second switching fork
29 Second fork opening
30 Pivot point
32 Pivot joint
34 Sleeve
36 Pivot point
38 Circular cylinder
40 Central axis
42 Face surface
44 Switching bolt
46 Switching shaft

What is claimed is:

1. A drive for a switch disconnector comprising:

a closed and off (C and O) switching capacity with a switching pin acting as a switching contact;

a spindle drive driven by an electric motor having a spindle nut; and an actuating element which is loaded by a compression spring and is capable of pivoting about a fixed pivot point and is acted upon by the spindle nut, wherein the actuating element interacts with an actuating device that actuates the switching pin, and wherein the actuating element is a double switching fork having a first switching fork and a second switching fork separated from each other by a fork opening and each of the first and second switching forks being at a predetermined angle with respect to each other, the double switching fork being configured to be engaged by the spindle nut, and to act upon an actuating disk or an actuating cylinder.

2. The drive as claimed in claim 1, wherein the actuating element is flexibly connected to the compression spring.

3. The drive as claimed in claim 1, wherein the compression spring is formed by a spring assembly which is bistably mounted.

4. The drive as claimed in claim 2, wherein the compression spring is mounted on a side opposite the connecting point of the actuating element.

5. The drive as claimed in claim 4, wherein the compression spring is mounted on the side opposite the connecting point of the actuating element via an immovable mount.

6. The drive as claimed in claim 1, wherein the actuating device is formed by an actuating disk or an actuating cylinder, a peripheral surface of the actuating disk or actuating cylinder engages with an actuating shaft in order to actuate the switching pin.

7. The drive as claimed in claim 6, wherein a face surface of the actuating disk or of the actuating cylinder is provided with at least one concentrically arranged actuating bolt which can be acted upon by the actuating element for the purpose of rotationally actuating the actuating cylinder.

8. The drive as claimed in claim 2, wherein the actuating device is formed by an actuating disk or an actuating cylinder, a peripheral surface of the actuating disk or actuating cylinder engages with an actuating shaft in order to actuate the switching pin.

9. The drive as claimed in claim 8, wherein a face surface of the actuating disk or of the actuating cylinder is provided with at least one concentrically arranged actuating bolt which can be acted upon by the actuating element for the purpose of rotationally actuating the actuating cylinder.

10. The drive as claimed in claim 3, wherein the actuating device is formed by an actuating disk or an actuating cylinder, a peripheral surface of the actuating disk or actuating cylinder engages with an actuating shaft in order to actuate the switching pin.

11. The drive as claimed in claim 10, wherein a face surface of the actuating disk or of the actuating cylinder is provided with at least one concentrically arranged actuating bolt which can be acted upon by the actuating element for the purpose of rotationally actuating the actuating cylinder.

12. The drive as claimed in claim 4, wherein the actuating device is formed by an actuating disk or an actuating cylinder, a peripheral surface of the actuating disk or actuating cylinder engages with an actuating shaft in order to actuate the switching pin.

13. The drive as claimed in claim 12, wherein a face surface of the actuating disk or of the actuating cylinder is provided with at least one concentrically arranged actuating bolt which can be acted upon by the actuating element for the purpose of rotationally actuating the actuating cylinder.

14. The drive as claimed in claim 1, wherein the compression spring has a spring force which establishes the C and O switching capacity of the drive.

15. The drive as claimed in claim 1, wherein the compression spring has a spring force which establishes the C and O switching capacity of the drive.

* * * * *